US009290942B2

(12) United States Patent
Jenkins et al.

(10) Patent No.: US 9,290,942 B2
(45) Date of Patent: Mar. 22, 2016

(54) ROOFING SHINGLE WITH ENHANCED SHADOWLINE APPEARANCE

(71) Applicant: CertainTeed Corporation, Valley Forge, PA (US)

(72) Inventors: Robert L. Jenkins, Honey Brook, PA (US); Gregory F. Jacobs, Oreland, PA (US)

(73) Assignee: CERTAINTEED CORPORATION, Malvern, PA (US)

( * ) Notice: Subject to any disclaimer, the term of this patent is extended or adjusted under 35 U.S.C. 154(b) by 0 days.

(21) Appl. No.: 14/136,542

(22) Filed: Dec. 20, 2013

(65) Prior Publication Data

US 2014/0193604 A1 Jul. 10, 2014

Related U.S. Application Data

(60) Provisional application No. 61/748,790, filed on Jan. 4, 2013.

(51) Int. Cl.
*E04D 1/26* (2006.01)
*E04D 1/12* (2006.01)

(52) U.S. Cl.
CPC ... *E04D 1/12* (2013.01); *E04D 1/26* (2013.01)

(58) Field of Classification Search
CPC ..... E04D 1/26; E04D 2001/005; Y10T 428/24372
USPC ..... 52/554–559
See application file for complete search history.

(56) References Cited

U.S. PATENT DOCUMENTS

| | | | | |
|---|---|---|---|---|
| 2,089,312 | A | | 8/1937 | Topping |
| 2,199,760 | A | | 5/1940 | Schuetz |
| 2,205,679 | A | | 6/1940 | Ames, Jr. |
| 2,335,493 | A | | 11/1943 | Drinkall |
| 2,977,924 | A | | 4/1961 | Bender et al. |
| 3,468,092 | A | | 9/1969 | Chalmers |
| 4,352,837 | A | | 10/1982 | Kopenhaver |
| D313,658 | S | * | 1/1991 | Noone ..... D25/139 |
| 5,181,361 | A | | 1/1993 | Hannah et al. |
| D344,144 | S | | 2/1994 | Weaver et al. |
| 5,287,669 | A | | 2/1994 | Hannah et al. |
| 5,347,785 | A | | 9/1994 | Terrenzio et al. |
| 5,375,387 | A | | 12/1994 | Davenport |
| 5,375,491 | A | | 12/1994 | Hannah et al. |
| 5,421,134 | A | | 6/1995 | Hannah et al. |
| 5,426,902 | A | | 6/1995 | Stahl et al. |
| D369,421 | S | | 4/1996 | Kiik et al. |
| 5,660,014 | A | | 8/1997 | Stahl et al. |
| 6,014,847 | A | | 1/2000 | Phillips |
| 6,190,754 | B1 | | 2/2001 | Bondoc et al. |
| 6,212,843 | B1 | | 4/2001 | Kalkanoglu et al. |
| 6,289,648 | B1 | | 9/2001 | Freshwater et al. |

(Continued)

*Primary Examiner* — Rodney Mintz
*Assistant Examiner* — Daniel Kenny
(74) *Attorney, Agent, or Firm* — Abel Law Group, LLP; Alexander H. Plache

(57) ABSTRACT

A roofing shingle may include a shingle body having a buttlap portion with a butt edge and a headlap portion. An exposure zone may extend from the butt edge toward the headlap portion and may be configured to be exposed to the environment when the roofing shingle is installed on a roof. The butt edge may be variegated and may include at least one tab. A first shadowline may be on at least a portion of the at least one tab. A second shadowline may be in the exposure zone. The first and second shadowlines may differ from each other in at least one aspect.

18 Claims, 2 Drawing Sheets

(56) References Cited

U.S. PATENT DOCUMENTS

| | | | | |
|---|---|---|---|---|
| 6,361,851 | B1 * | 3/2002 | Sieling et al. | 428/144 |
| D466,629 | S * | 12/2002 | Phillips | D25/139 |
| 6,692,608 | B2 * | 2/2004 | Phillips | 156/260 |
| 6,698,151 | B2 | 3/2004 | Elliott | |
| 6,748,714 | B2 | 6/2004 | Elliot | |
| 6,933,037 | B2 | 8/2005 | McCumber et al. | |
| 7,665,261 | B2 * | 2/2010 | Elliott et al. | 52/557 |
| 2004/0079042 | A1 | 4/2004 | Elliot | |
| 2012/0260597 | A1 | 10/2012 | Jenkins et al. | |

* cited by examiner

ROOFING SHINGLE WITH ENHANCED SHADOWLINE APPEARANCE

CROSS-REFERENCE TO RELATED APPLICATION(S)

The present application claims priority from U.S. Provisional Application No. 61/748,790, filed Jan. 4, 2013, entitled "Roofing Shingle With Enhanced Shadowline Appearance" naming inventors Robert L Jenkins and Gregory F. Jacobs, which application is incorporated by reference herein its entirety.

BACKGROUND OF THE INVENTION

1. Field of the Disclosure

The present invention relates in general to roofing shingles and, in particular, to a system, method and apparatus for a roofing shingle with an enhanced shadowline appearance.

2. Description of the Related Art

In the art of shingle and siding manufacture, it is known to manufacture shingles of an asphalt impregnated organic or inorganic web, having granules on an outer surface thereof, and having smaller particles on an opposite surface, comprising complete layers of shingle material, examples of which are present in U.S. Pat. Nos. 4,352,837; 5,181,361; 5,287,669; 5,347,785; 5,375,491; 5,421,134; 5,426,902, as well as many other patents. Sometimes, these shingles are comprised of a plurality of complete layers of shingle material, adhered together as a laminate, and sometimes they are comprised of a single complete layer of shingle material, with or without an overlay comprised of an additional layer of adhesive, and an additional layer of granules applied thereto. In addition to structures such as the above identified shingles functioning as shingles, sometimes similar structures are used to function as components of siding, to be applied to side walls of a building structure, rather than the roof of a building structure. Accordingly, improvements in the appearance of roofing shingles continue to be of interest.

SUMMARY

Embodiments of a system, method and apparatus for a roofing shingle may comprise a shingle body having a buttlap portion with a butt edge and a headlap portion. An exposure zone may extend from the butt edge toward the headlap portion and may be configured to be exposed to the environment when the roofing shingle is installed on a roof. The butt edge may be variegated and may include at least one tab. A first shadowline may be on at least a portion of the at least one tab. A second shadowline may be in the exposure zone. The first and second shadowlines may differ from each other in at least one aspect.

In other embodiments, an array of roofing shingles may have a first course underlying a second course on a roof. Each roofing shingle may comprise a shingle body having a buttlap portion with a butt edge and a headlap portion. An exposure zone may extend from the butt edge toward the headlap portion and may be exposed to the environment. The butt edge may be variegated and may include at least one tab. A first shadowline may be on at least a portion of the at least one tab. A second shadowline may be in the exposure zone. The first and second shadowlines may differ from each other in color. The second shadowline of the first course may at least partially underlie the at least one tab of the second course, such that the second shadowline may be at least partially exposed even when at least partially covered by the at least one tab of the second course.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Figure 1:
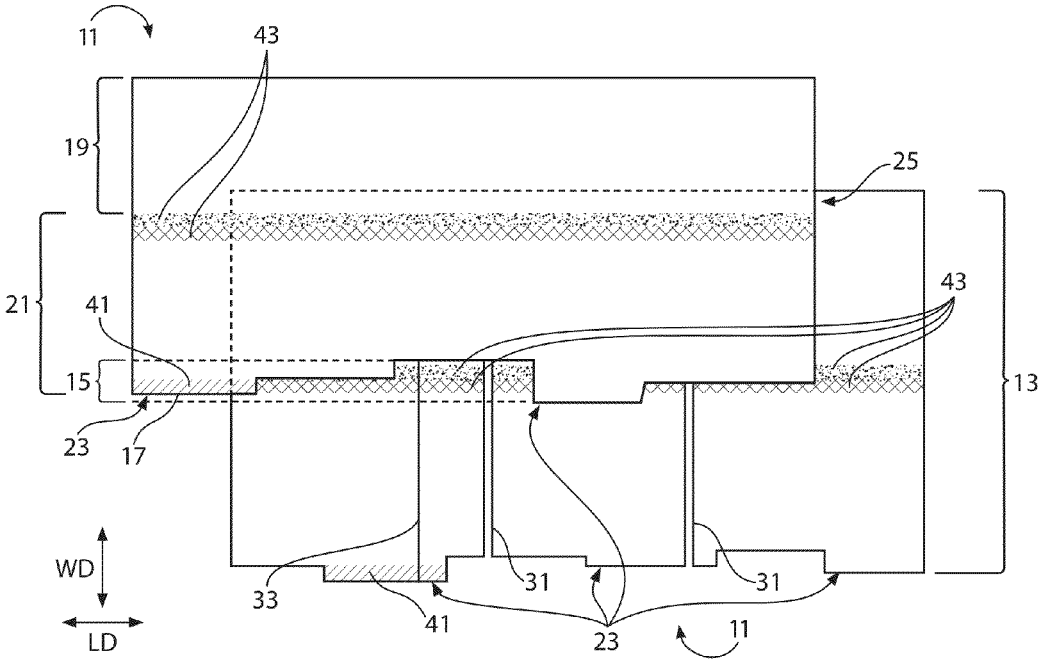
FIGS. 1-3 are plan views of embodiments of two courses of roofing shingles.
Figure 2:
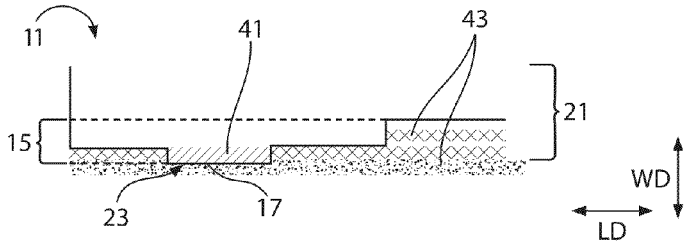
Figure 3:
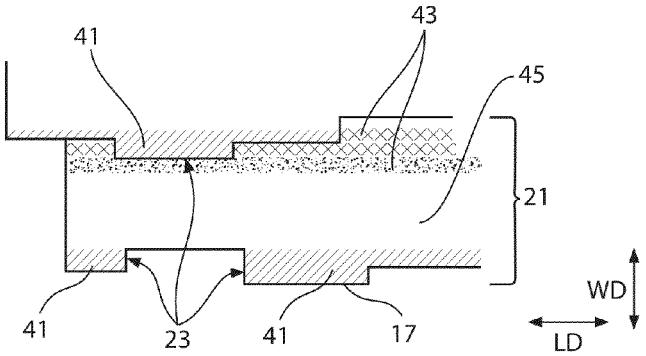

As shown in FIGS. 1-3, embodiments of a roofing shingle 11 may comprise a shingle body 13 that may be formed from a material that is bituminous, thermoplastic, thermoset polymer, metallic, recycled material or a combination thereof. The shingle body 13 may include a buttlap portion 15 with a butt edge 17 and a headlap portion 19. An exposure zone 21 may extend in a width direction WD from the butt edge 17 toward the headlap portion 19. The exposure zone 21 is configured to be exposed to the environment when the roofing shingle 11 is installed on a roof (see, e.g., FIGS. 4 and 5). In this disclosure, the term "buttlap portion" 15 may be defined in some embodiments as a subset of the exposure zone 21, such that it represents the width range over which the butt edge 17 may vary. In addition, the shingle body 13 may comprise one layer, or more than one layer in the exposure zone 21, and each layer may be either continuous or discontinuous.

Embodiments of the butt edge 17 are variegated as opposed to conventional dragon's tooth designs, which are typically symmetrical. The term "variegated", as used herein, refers to an irregular edge that is non-symmetrical, asymmetrical, and which may have multiple or variable widths (e.g., 4 different widths in the width direction). Variegated butt edges 17 may be rectilinear, non-linear, or not co-linear and include at least one tab 23. In some embodiments, the variegated butt edge 17 is discontinuous and is not dragon toothed. Moreover, the variegated butt edge 17 may include a single layer, or a laminate composed of more than one layer. For example, U.S. Pat. App. Pub. 2012/0260597, published Oct. 18, 2012, discloses some laminated roofing products, and is incorporated herein by reference in its entirety.

Unlike the widths of some embodiments of variegated butt edges 17, the widths of dragons teeth are as wide as the exposure zone 21, and can extend adjacent the fastening zone 25 in the headlap portion 19. Thus, the variegated butt edge 17 may have a width that is less than a width of the exposure zone 21, such that the variegated butt edge 17 does not extend to the fastening zone 25 in the headlap portion 19. Thus, the term "variegated" may include a width that is less than that of the exposure zone 21, does not extend to the fastening zone 25, and only varies in width from the butt edge 17 by about +/−5% to about +/−25%. These percentage variances may reflect a measurement relative to an entire width of the exposure zone 21 (i.e., as a percentage of the exposure zone 21), or as a percentage variance from a nominal width measurement of the butt edge 17.

Embodiments of the variegated butt edge 17 may vary in width by at least about 2%. For example, variegated butt edge widths may vary by at least about 5%, such as at least about 8%, or even at least about 10%. In other embodiments, the variegated butt edge may vary in width by not greater than about 25%, such as not greater than about 20%, not greater than about 15%, or even not greater than about 12%. The width of the variegated butt edge 17 also may be in a range between any of the preceding minimum and maximum values.

In some embodiments, the variegated butt edge 17 may be interrupted by at least one cut out 31, slot or slit 33, such that the variegated butt edge 17 may be sectioned into smaller portions or partial portions to define a plurality of tabs 23. In other embodiments, the variegated butt edge 17 does not have cut outs, slots or slits, and is not sectioned or interrupted into smaller portions either wholly or partially by such features. In addition, the variegated butt edge 17 may have at least one edge portion that is straight, curved or has other geometric shape, profile or design, or is a combination of multiple geometric shapes.

Embodiments of the roofing shingle 11 also may comprise a first shadowline 41 on at least a portion of the at least one tab 23, and a second shadowline 43 in the exposure zone 21. The first and second shadowlines 41, 43 may differ from each other in at least one aspect.

For example, the at least one aspect may be color variation, coatings, density, embedment, size or shape of the granules, etc. In some embodiments, the first and second shadowlines 41, 43 may differ from each other in color by at least about 2 L*CIE color units, such as at least about 5 L*CIE color units, at least about 10 L*CIE color units, or even at least about 15 L*CIE color units. In other versions, the first and second shadowlines 41, 43 may differ from each other in color by not greater than about 50 L*CIE color units, such as not greater than about 40 L*CIE color units, not greater than about 30 L*CIE color units, or even not greater than about 20 L*CIE color units. The color variation also may be in a range between any of the preceding minimum and maximum values. The color measurement L* may be obtained with, for example, a Hunter LabScan instrument with a 0°/45° geometry and a 2° standard observer and source C illuminant.

In some embodiments, at least one of the shadowlines is discontinuous or interrupted in at least one of a width direction and a length direction. For example, at least a portion of at least one shadowline 41, 43 may be interrupted at the variegated butt edge 17 of an adjacent course of roofing shingle 11. The first and second shadowlines 41, 43 may have a same width, or different widths. One or more of the shadowlines 41, 43 may be continuous and oscillate or vary in width in a length direction LD for at least one roof shingle 11 in a course of more than one roofing shingle 11. In other versions, a same shadowline tone or color may be repeated with either a darker or lighter color tone as a separation therebetween in the length direction LD. More than one shadowline 41, 43 may vary in color and go from darker to lighter, or lighter to darker, in the width direction WD.

The second shadowline 43 may be positioned to at least partially underlie the at least one tab 23 of a subsequent course of roofing shingle 11. For example, the second shadowline 43 may be at least partially exposed even when at least partially covered by the at least one tab 23 of the subsequent course of roofing shingle 11.

In addition, the second shadowline 43 may comprise a plurality of second shadowlines 43 (e.g., two shown) in the exposure zone 21. Each of the second shadowlines 43 may vary in at least one aspect with respect to the other second shadowlines 43. Likewise, the first shadowline 41 may comprise a plurality of first shadowlines 41 on the at least one tab 23. Each of the first shadowlines 41 may vary in at least one aspect with respect to the other first shadowlines 41.

In some embodiments, the second shadowline 43 may be located in the headlap portion 19 (FIG. 1). In some versions, the second shadowline 43 may be formed from the same material as the headlap portion 19. Embodiments of the second shadowline 43 may be visible as shown and/or through one or more of the cut outs 31 of a subsequent course of roofing shingles 11.

The plurality of second shadowlines 43 may be configured to underlie the at least one tab 23 of a subsequent course of roofing shingle 11. The roofing shingle 11 may further comprise a color separation or space 45 (FIG. 3) between at least some of the plurality of second shadowlines 43 in a color similar to a primary blend or a complementary color of the roofing shingle 11.

The at least one tab 23 may comprise a plurality of tabs 23 with varying widths that are configured to at least partially cover the second shadowline 43 of a previous course of roofing shingle 11 by different amounts, as shown. Thus, at least one of the plurality of second shadowlines 43 may be configured to at least partially underlie at least one of the plurality of tabs 23 of a subsequent course of roofing shingle 11.

In addition, the plurality of tabs 23 may comprise differing tab widths with one or more variegated or discontinuous lower edge profiles 17 on individual ones of the plurality of tabs 23. In FIG. 3, for example, the uppermost tab 23 has a lower edge that overlies only one of the second shadowlines 43, and is located at the intersection between the two second shadowlines 43. However, the lower edge may terminate in the upper second shadowline 43, in the lower second shadowline 43, or extend beyond the lower second shadowline 43 even further into the color separation or space 45.

In still other embodiments, the exposure zone 21 may comprise a primary shingle color that is of a blend of two or more different colored blend drops or tones, with or without a mix or a single granule color tone or two or more mixed individual granule color. The second shadowline 43 may be located at an upper end of the exposure zone 21 adjacent the primary shingle color.

Figure 4:
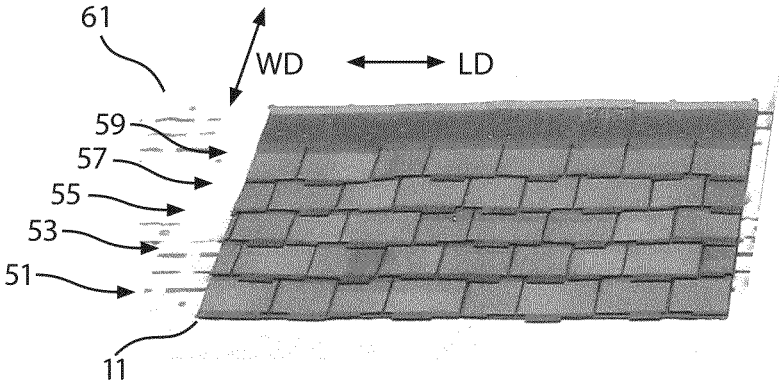
FIGS. 4 and 5 are top isometric views of embodiments of arrays of roofing shingles on a roof.
Figure 5:
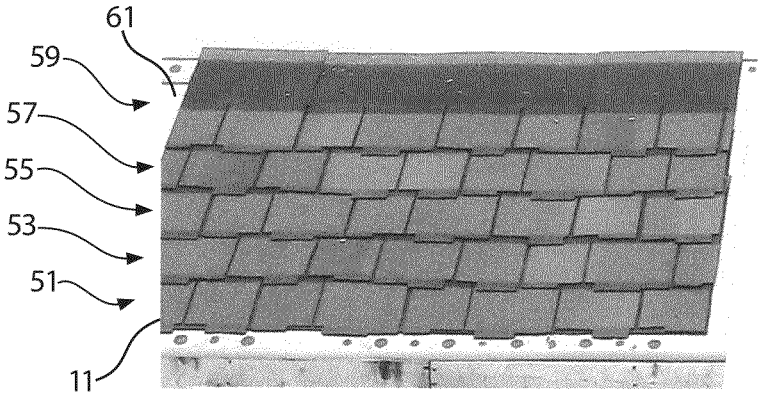

Referring now to FIGS. 4 and 5, embodiments of an array of roofing shingles 11 may have a plurality of courses, such as a first course 51 underlying a second course 53, which underlies a third course 55, which underlies a fourth course 57, which underlies a fifth course 59, etc., on a roof 61.

The roofing shingles 11 may comprise the various embodiments disclosed herein. For example, each roofing shingle 11 may have a shingle body 13 with a buttlap portion 15 and a butt edge 17, and a headlap portion 19. An exposure zone 21 may extend from the butt edge 17 toward the headlap portion 19 and is exposed to the environment. The butt edge may be variegated and include at least one tab 23. A first shadowline 41 may be on at least a portion of the at least one tab 23. A second shadowline 43 may be in the exposure zone 21. The first and second shadowlines 41, 43 may differ from each other in color. The second shadowline 43 of the first course 51 may at least partially underlie the at least one tab 23 of the second course 53, such that the second shadowline 43 is at least partially exposed even when at least partially covered by the at least one tab 23 of the second course 53.

A plurality of second shadowlines 43 may be on the first course 51 and underlie the at least one tab 23 of the second course 53. The array may further comprise a color separation or space between at least some of the plurality of second shadowlines 43 in a color similar to a primary blend or a complementary color of the roofing shingles 11. The at least one tab 23 may comprise a plurality of tabs 23 with varying widths that at least partially cover the second shadowlines 43 of the first course 51 by different amounts. At least a portion of at least one shadowline 41, 43 may be interrupted at the variegated butt edge 17 of an adjacent course of roofing shingle 11.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A roofing shingle, comprising:

a shingle body consisting of a single layer having a rectangular shape, a buttlap portion with a butt edge, a headlap portion, an exposure zone extending from the butt edge toward the headlap portion in a width direction, and the exposure zone is configured to be exposed to the environment when the roofing shingle is installed on a roof; wherein the buttlap portion is variegated and includes at least one tab;

a first shadowline of granules on at least a portion of the at least one tab of the single layer shingle body;

a plurality of second shadowlines of granules in the exposure zone of the single layer shingle body, each of second shadowlines varies in at least one aspect with respect to the other second shadowlines; and the first and second shadowlines also differ from each other in said at least one aspect; and a space between the first and second shadowlines on the single layer shingle body.

2. The roofing shingle of claim 1, wherein the at least one aspect is color variation, and both the first shadowline and the second shadowlines extend in a length direction, and at least two of the second shadowlines are spaced apart from each other in the width direction.

3. The roofing shingle of claim 1, wherein the first and second shadowlines differ from each other in color by at least about 2 L*CIE color units and not greater than about 50 L*CIE color units, and the variegated buttlap portion does not have cut outs and is not sectioned or interrupted into smaller portions either wholly or partially by cut outs or a cut or slit.

4. The roofing shingle of claim 1, wherein the first and second shadowlines comprise a color separation in a color similar to a primary blend or a complementary color of the roofing shingle.

5. The roofing shingle of claim 1, wherein the variegated buttlap portion has a width that is less than a width of the exposure zone, and the variegated buttlap portion does not extend to a fastening zone in the headlap portion, and the first and second shadowlines have a same width.

6. The roofing shingle of claim 1, wherein the variegated buttlap portion varies in width by at least about 2% and not greater than about 25%, and at least one of the shadowlines is discontinuous or interrupted in at least one of a width direction and a length direction.

7. The roofing shingle of claim 1, wherein the at least one tab comprises a plurality of tabs with varying widths that are configured to at least partially cover the second shadowlines of a previous course of roofing shingle by different amounts, and a same shadowline tone or color is repeated with either a darker or lighter color tone as a separation therebetween in a length direction.

8. The roofing shingle of claim 1, wherein at least a portion of at least one shadowline is interrupted at the variegated buttlap portion of an adjacent course of roofing shingle, and the first shadowline is on one tab, but not on another tab.

9. The roofing shingle of claim 1, wherein one or more of the first and second shadowlines is continuous and oscillates or varies in width in a length.

10. The roofing shingle of claim 1, wherein more than one shadowline varies in color and goes from darker to lighter, or lighter to darker, in a width direction.

11. The roofing shingle of claim 1, wherein the exposure zone comprises a primary shingle color that is of a blend of two or more different colored blend drops or tones; and the second shadowlines are located at an upper end of the exposure zone adjacent the primary shingle color.

12. A roofing shingle, comprising:

a shingle body consisting of a single layer having a rectangular shape, a buttlap portion with a butt edge, a headlap portion, an exposure zone extending from the butt edge toward the headlap portion, and the exposure zone is configured to be exposed to the environment when the roofing shingle is installed on a roof; wherein the buttlap portion is variegated, includes at least one tab, and the buttlap portion does not have cut outs and is not sectioned or interrupted into smaller portions either wholly or partially by cut outs or a cut or slit on the single layer shingle body;

a first shadowline of granules on at least a portion of the at least one tab on the single layer shingle body;

a second shadowline of granules in the exposure zone on the single layer shingle body; and the first and second shadowlines differ from each other in at least one aspect.

13. The roofing shingle of claim 12, wherein the second shadowline comprises a plurality of second shadowlines in the exposure zone, each of which varies in at least one aspect with respect to the other second shadowlines.

14. The roofing shingle of claim 13, further comprising a space comprising a color separation between the second shadowlines in the width direction.

15. The roofing shingle of claim 12, wherein the variegated buttlap portion does not extend to a fastening zone in the headlap portion, and the first and second shadowlines have a same width.

16. The roofing shingle of claim 12, wherein the first shadowline is on one tab, but not on another tab.

17. The roofing shingle of claim 12, wherein at least one of the first and second shadowlines is continuous and oscillates or varies in width in a length direction.

18. A roofing shingle, comprising:

a shingle body comprising a single layer having a rectangular shape, a buttlap portion with a butt edge, a headlap portion, an exposure zone extending in a width direction from the butt edge toward the headlap portion, and the exposure zone is configured to be exposed to the environment when the roofing shingle is installed on a roof; wherein the buttlap portion is variegated and includes at least one tab on the single layer shingle body, and the buttlap portion does not have cut outs and is not sectioned or interrupted into smaller portions either wholly or partially by cut outs or a cut or slit on the single layer shingle body;

a first shadowline on at least a portion of the at least one tab on the single layer shingle body;

at least two second shadowlines in the exposure zone on the single layer shingle body, the at least two second shadowlines are spaced apart from each other in the width direction, and the at least two second shadow lines vary in color with respect to each other; and the first and second shadowlines differ from each other in color.

* * * * *